US012564247B2

(12) United States Patent
Rhulen et al.

(10) Patent No.: US 12,564,247 B2
(45) **Date of Patent: *Mar. 3, 2026**

(54) ARTICLE OF FOOTWEAR WITH REEL CLOSURE AND SLIDABLE EYELET

(71) Applicant: NIKE, Inc., Beaverton, OR (US)

(72) Inventors: Blake Rhulen, Portland, OR (US); Carl L. Madore, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/824,120

(22) Filed: Sep. 4, 2024

(65) Prior Publication Data

US 2024/0423325 A1 Dec. 26, 2024

Related U.S. Application Data

(63) Continuation of application No. 17/577,522, filed on Jan. 18, 2022, now Pat. No. 12,102,190, which is a continuation of application No. 16/407,828, filed on May 9, 2019, now Pat. No. 11,253,030, which is a continuation of application No. 14/944,762, filed on Nov. 18, 2015, now Pat. No. 10,327,514.

(60) Provisional application No. 62/167,661, filed on May 28, 2015.

(51) Int. Cl.

| | |
|---|---|
| ***A43C 5/00*** | (2006.01) |
| ***A43C 3/00*** | (2006.01) |
| ***A43C 7/00*** | (2006.01) |

(52) U.S. Cl.

CPC ..... *A43C 5/00* (2013.01); *A43C 3/00* (2013.01); *A43C 7/00* (2013.01)

(58) Field of Classification Search

CPC ..... A43C 5/00; A43C 7/00; A43C 3/00
USPC ..... 36/50.1
See application file for complete search history.

(56) References Cited

U.S. PATENT DOCUMENTS

| | | | | | |
|---|---|---|---|---|---|
| 155,156 | A | * | 9/1874 | Henry | A43C 7/00 24/712.5 |
| 1,407,705 | A | * | 2/1922 | Munter | A41F 1/04 450/119 |
| 4,270,227 | A | * | 6/1981 | Wolfe | A43B 7/08 2/87 |
| 4,414,761 | A | * | 11/1983 | Mahood | A43C 1/00 24/712 |
| 4,790,048 | A | * | 12/1988 | Arnt | A43C 7/00 24/712.1 |
| 4,794,674 | A | * | 1/1989 | Mintel | A43C 11/14 24/712.1 |
| 4,916,833 | A | * | 4/1990 | Nwoko | A43C 5/00 24/712.2 |
| 4,991,273 | A | * | 2/1991 | Huttle | A43C 1/00 24/712.1 |

(Continued)

*Primary Examiner* — Katharine G Kane
(74) *Attorney, Agent, or Firm* — Shook, Hardy & Bacon L.L.P

(57) ABSTRACT

An article of footwear includes an upper, a sole structure coupled to the upper, a plurality of string pairs, a plurality of eyelets, and a reel-based closure system. Each string pair includes a first string and a second string. Each eyelet slidably couples the first string to the second string of one of the plurality of string pairs, and each eyelet defines a first aperture and a second aperture. The reel-based closure system is operatively coupled to at least one of the first string or the second string of at least one of the plurality of string pairs.

13 Claims, 2 Drawing Sheets

(56) References Cited

U.S. PATENT DOCUMENTS 5,117,567 A * 6/1992 Berger ..... A43C 11/16 36/50.1
5,177,882 A * 1/1993 Berger ..... A43C 11/165 36/50.1
5,181,331 A * 1/1993 Berger ..... A43C 11/00 24/712.1
5,341,583 A * 8/1994 Hallenbeck ..... A43C 11/00 36/50.1
5,381,609 A * 1/1995 Hieblinger ..... A43C 11/00 36/50.1
5,463,822 A * 11/1995 Miller ..... A43C 11/00 36/50.1
5,469,640 A * 11/1995 Nichols ..... A43C 11/008 24/712.1
5,477,593 A * 12/1995 Leick ..... A43C 7/00 24/712.1
5,651,195 A * 7/1997 Clancy ..... A43B 3/12 36/11.5
5,651,198 A * 7/1997 Sussmann ..... A43C 11/00 36/50.1
5,953,800 A * 9/1999 Duckett ..... F16G 11/14 24/712.1
6,026,548 A * 2/2000 Jackson ..... A43C 9/00 24/712.1
6,073,370 A * 6/2000 Okajima ..... A43B 11/00 36/89
6,282,817 B1 * 9/2001 Curet ..... A43C 7/04 24/712.1
6,381,816 B1 * 5/2002 Lai ..... A43C 7/00 24/712.9
6,449,881 B1 * 9/2002 Assaf ..... A43B 23/26 150/144
6,601,323 B2 * 8/2003 Tsujino ..... A43C 7/02 24/712.3
6,640,466 B1 * 11/2003 Liu ..... A43C 11/1406 36/50.1
6,735,829 B2 * 5/2004 Hsu ..... A43C 3/00 24/712.9
6,757,991 B2 * 7/2004 Sussmann ..... A43C 11/008 36/50.1
6,817,070 B1 * 11/2004 Liu ..... A43C 7/00 24/712.9
D507,402 S * 7/2005 Laberge ..... D2/972
6,922,917 B2 * 8/2005 Kerns ..... A43B 5/14 36/50.1
D509,348 S * 9/2005 Brewer ..... D2/972
7,347,012 B2 * 3/2008 Clark ..... A43B 13/12 36/50.1
7,574,786 B2 * 8/2009 Cheng ..... F16G 11/101 24/712.2
8,056,265 B2 * 11/2011 Pirkle ..... A43C 7/00 24/712.1
8,061,061 B1 * 11/2011 Rivas ..... A43C 11/165 36/137
8,387,282 B2 * 3/2013 Baker ..... A43C 11/008 36/133
8,468,657 B2 * 6/2013 Soderberg ..... A63B 71/0622 242/395
8,533,978 B2 * 9/2013 Volin ..... A43B 3/0078 24/712.2
8,713,820 B2 * 5/2014 Kerns ..... A43C 11/165 36/88
9,149,089 B2 * 10/2015 Cotterman ..... A43C 3/00
D767,269 S * 9/2016 Lovett ..... D2/978
9,622,546 B2 * 4/2017 Turdjian ..... A44B 11/06
9,743,709 B2 * 8/2017 Hesterberg ..... A43B 13/16
10,582,741 B2 * 3/2020 Dombrow ..... A43C 1/04
2006/0000116 A1 * 1/2006 Brewer ..... A43C 1/04 36/11.5
2007/0169378 A1 * 7/2007 Sodeberg ..... A45C 7/0063 36/50.5
2009/0038128 A1 * 2/2009 Cho ..... A43C 11/1493 24/68 SK
2009/0133236 A1 * 5/2009 Vazin ..... A43C 11/24 24/713
2011/0162236 A1 * 7/2011 Voskuil ..... A43B 3/0078 24/713.6
2011/0225843 A1 * 9/2011 Kerns ..... A43C 11/20 36/50.1
2011/0258876 A1 * 10/2011 Baker ..... A43C 11/1493 36/50.1
2015/0173459 A1 * 6/2015 Yang ..... A43C 7/00 24/713.2
2016/0345680 A1 * 12/2016 Rhulen ..... A43C 7/00
2017/0027286 A1 * 2/2017 Luedecke ..... A43C 1/00
2017/0065029 A1 * 3/2017 Bordin ..... A43C 1/00

* cited by examiner

ARTICLE OF FOOTWEAR WITH REEL CLOSURE AND SLIDABLE EYELET

CROSS-REFERENCE TO RELATED APPLICATIONS

The present disclosure is a continuation of U.S. patent application Ser. No. 17/577,522, filed on Jan. 18, 2022, which is a continuation of U.S. patent application Ser. No. 16/407,828, filed on May 9, 2019, now U.S. Pat. No. 11,253,030, which is a continuation of U.S. patent application Ser. No. 14/944,762, filed on Nov. 18, 2015, now U.S. Pat. No. 10,327,514, which claims priority, and the benefit of, U.S. Provisional Patent Application No. 62/167,661, filed on May 28, 2015, the entire disclosure of each is incorporated by reference herein.

TECHNICAL FIELD

The present disclosure relates to a article of footwear with a reel closure and slidable eyelet.

BACKGROUND

Footwear typically includes an upper and a sole coupled to the upper. In addition, the footwear may include laces for adjusting the upper to the wearer's foot. The laces may be connected to the upper in order to allow the wearer to tighten the laces.

SUMMARY

The present disclosure relates to an eyelet for an article of footwear. In an embodiment, the eyelet includes an eyelet body configured to slidably couple a first string to a second string. The eyelet body defines a first arc-shaped aperture and an opposing, second arc-shaped aperture. The first arc-shaped aperture is configured to slidably receive the first string, and the second arc-shaped aperture is configured to slidably receive the second string. The eyelet may be disposed over (but not necessarily attached to) an upper of an article of footwear. The article of footwear includes an upper and a sole structure coupled to the upper. During operation, the slidable motion of the second string relative to the eyelet is operative to adjust the position of the upper relative to the sole structure.

The above features and advantages and other features and advantages of the present teachings are readily apparent from the following detailed description of the best modes for carrying out the teachings when taken in connection with the accompanying drawings.

DETAILED DESCRIPTION

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items.

Those having ordinary skill in the art will recognize that terms such as "above," "below," "upward," "downward," "top," "bottom," etc., are used descriptively for the figures, and do not represent limitations on the scope of the present teachings, as defined by the claims.

Figure 1:
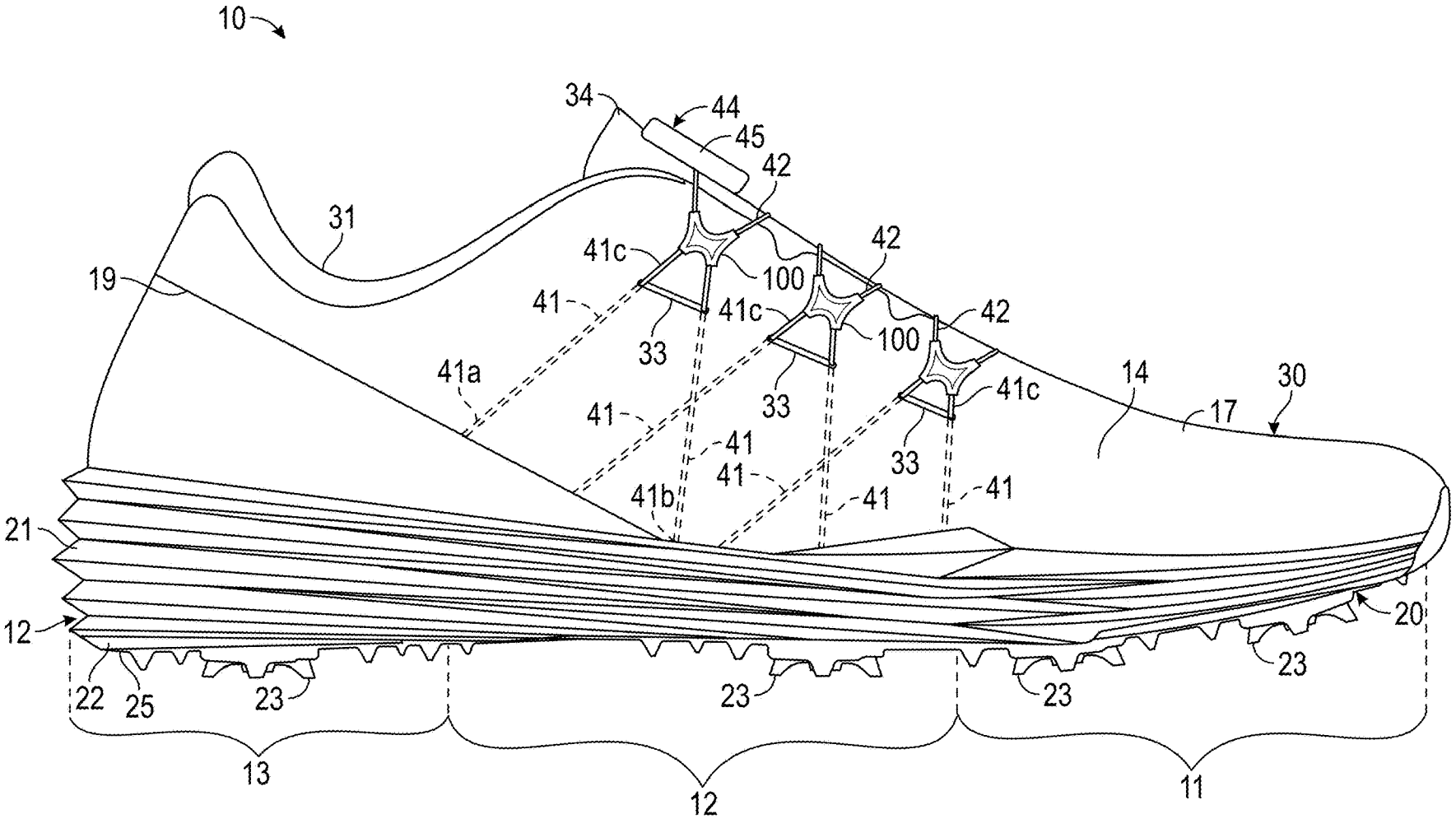
FIG. 1 is a schematic, side view of an article of footwear including a plurality of eyelets.

Referring to the drawings, wherein like reference numbers refer to like components throughout the views, FIG. 1 schematically illustrates an article of footwear 10 including a sole structure 20 and an upper 30 coupled to the sole structure 20. For reference purposes, article of footwear 10 may be a golf shoe and may be divided into three general regions: a forefoot region 11, a midfoot region 12, and a heel region 13. The footwear 10 also includes a lateral side 14 and a medial side opposite to the lateral side 14. The forefoot region 11 generally includes portions of the article of footwear 10 corresponding with the toes and the joints connecting the metatarsals with the phalanges. The midfoot region 12 generally includes portions of the article of footwear 10 corresponding with the arc area of the foot, and the heel region 13 corresponds with rear portions of the foot, including the calcaneus bone. The lateral side 14 and medial side (not shown) extend through each of forefoot region 11, the midfoot region 12, and the heel region 13 and correspond with opposite sides of the article of footwear 10. The forefoot region 11, the midfoot region 12, the heel region 13, the lateral side 14 and the medial side are not intended to demarcate precise areas of footwear 10. Rather, the forefoot region 11, the midfoot region 12, the heel region 13, the lateral side 14 and the medial side are intended to represent general areas of footwear 10 to aid in the following discussion. In addition to the article of footwear 10, forefoot region 11, the midfoot region 12, the heel region 13, the lateral side 14 and the medial side may also be applied to sole structure 20, upper 30, and individual elements thereof.

The sole structure 20 is secured to the upper 30 and extends between the foot and the ground when the article of footwear 10 is worn. The primary elements of sole structure 20 are a midsole 21, an outsole 22, and a sockliner (not shown). The midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, the midsole 21 may incorporate fluid-filled chambers, plates, moderators, or other elements that further attenuate forces, enhance stability, or influence the motions of the foot, or the midsole 21 may be primarily formed from a fluid-filled chamber. The outsole 22 is secured to a lower surface of the midsole 21 and may be formed from a wear-resistant rubber material that is textured to impart traction. The sockliner is located within the upper 30 and is positioned to extend under a lower surface of the foot. Although this configuration for sole structure 20 provides an example of a sole structure that may be used in connection with the upper 30, a variety of other conventional or nonconventional configurations for the sole structure 20 may also be utilized. Accordingly, the structure and features of the sole structure 20 or any sole structure utilized with the upper 30 may vary considerably.

The sole structure 20 further includes traction elements 23 disposed along the outsole 22. Although the drawings show a specific number of traction elements 23 at specific locations in the outsole 22, it is contemplated that the sole structure 20 may include more or fewer traction elements 23 at different locations relative to the outsole 22. In the depicted embodiment, the traction elements 23 can be removably mounted to the outsole 22. At least a portion of each traction element 23 extends beyond the outer outsole surface 25.

The various portions of the upper 30 may be formed from one or more of a plurality of material elements (e.g., textiles, polymer sheets, foam layers, leather, synthetic leather) that are stitched or bonded together to form a void within the article of footwear 10 for receiving and securing a foot relative to the sole structure 20. The void is shaped to accommodate the foot and extends along the lateral side of the foot, along the medial side of the foot, over the foot, around the heel, and under the foot. Access to the void is provided by an ankle opening 31 at least partly located in the heel region 13. The upper 30 further includes a cover layer 17 and a tongue 34 movably coupled to the cover layer 17. The tongue 34 extends over the interior void of the upper 30 in order to enhance the comfort of the article of footwear 10.

The article of footwear 10 further includes one or more first strings 41 disposed on one or both of lateral side 14 and medial side. In the present disclosure, the term "string" means a flexible, elongated structure capable of withstanding a tensile load. As non-limiting examples, the term "string" includes, but is not limited to, a cable, a lace, a strand, a wire, a cord, among others. The first strings 41 extend downward from the various string openings 33. The string openings 33 may be configured as slots or slits and are located closer to the tongue 34 than to the sole structure 20. In the depicted embodiment, the first strings 41 extend from a lace region of the upper 30 (i.e., the region where string openings 33 or other lace-receiving elements are located) to a lower region of the upper 30 (i.e., the region where sole structure 20 joins with the upper 30). The first strings 41 may be coupled (e.g., directly attached) to the sole structure 20, the heel cup 19, or both. Specifically, each of the first strings 41 includes a first string end 41*a* and a second string end 41*b*, and the first and second string ends 41*a*, 41*b* are coupled to the sole structure 20, the heel cup 19, or both. For instance, the first and second string ends 41*a*, 41*b* may be directly bonded to the sockliner of the sole structure 20. The number of first strings 41 may vary and, in the depicted embodiment, the first strings 41 are oriented in a rearwardly-angled direction in the area between the string openings 33 and the sole structure 20. However, it is contemplated that the first strings 41 may be oriented vertically relative to the sole structure 20. Regardless of its orientation, the first strings 41 may be partially embedded inside the upper 30. For instance, the first strings 41 may be disposed between an inner layer (not shown) and the cover layer 17 of the upper. Each of the first strings 41 includes an intermediate string portion 41*c* disposed between the first string end 41*a* and the second string end 41*b*. The intermediate string portion 41*c* extends through the string opening 33 and is therefore disposed outside the upper 30. Each intermediate string portion 41*c* is slidably coupled to an eyelet 100.

During activities that involve walking, running, or other ambulatory movements (e.g., cutting, braking), a foot within the void in the article of footwear 10 may tend to stretch the upper 30. That is, many of the material elements forming the upper 30 may stretch when placed in tension by movements of the foot. Although the first strings 41 may also stretch, the first strings 41 generally stretch to a lesser degree than the other material elements forming the upper 30. Each of the first strings 41 and the second strings 42 may be located, therefore, to form structural components in the upper 30 that (a) resist stretching in specific directions or locations, (b) limit excess movement of the foot relative to the sole structure 20 and the upper 30, (c) ensure that the foot remains properly positioned relative to the sole structure 20 and the upper 30, and (d) reinforce locations where forces are concentrated. As non-limiting examples, suitable materials for the first strings 41 include various filaments, fibers, yarns, threads, cables, or ropes that are formed from rayon, polyamide, polyester, polyacrylic, silk, cotton, carbon, glass, aramids (e.g., para-aramid fibers and meta-aramid fibers), ultra-high molecular weight polyethylene, liquid crystal polymer, copper, aluminum, or steel.

The article of footwear 10 further includes one or more second strings 42 (.e.g., laces) extending through various eyelets 100 and along part of the lateral side 14 and the medial side of the upper 30. For example, the second strings 42 may extend over the tongue 34 of the upper 30 and part of the cover layer 17. As such, the second string 42 can be cinched to permit the wearer to modify dimensions of the upper 30 to accommodate the proportions of the foot. More particularly, the second string 42 permits the wearer to tighten the upper 30 around the foot and to loosen the upper 30 to facilitate entry and removal of the foot from the void (i.e., through ankle opening 31). As non-limiting examples, the second strings 42 may be a cable, a lace, a strand, a wire, cord, among others. In the depicted embodiment, the second string 42 is a cable, and the first string 41 is a wire. The second string 42 may be operatively coupled to a reel based closure system 44 configured to tighten or loosen the first string 41 and the second string 42. As non-limiting examples, the article of footwear 10 may include a reel based closure system as described in U.S. Patent Publication Nos. 2015/0033519 and 2014/0290016, which are hereby incorporated by reference in their entirety. The reel based closure system 44 includes a rotatable knob 45. During operation, a user can turn the rotatable knob 45 in order to reel the second string 42, thereby tightening or loosening the first string 41 and the second string 42. Because the first strings 41 are attached to the bottom of the article of footwear 10 (e.g., the sole structure 20), the first strings 41 and the second strings 42 provide the user with more freedom to tighten or loosen the article of footwear 10 in comparison to conventional articles of footwear. To this end, the article of footwear 10 includes at least one eyelet 100 slidably coupling at least one of the first strings 41 to at least one of the second strings 42. The eyelets 100 therefore allow the user to adjust (e.g., tightening or loosening) the first strings 41 and/or the second strings 42 while minimizing friction between the first strings 41 and the second strings 42. Although the depicted embodiment shows the reel based closure system 44 operatively coupled to the second strings 42, it is envisioned that the reel based closure system 44 may be operatively coupled to the first strings 41, the second strings 42, or both. Alternatively, the article of footwear 10 may include one reel based closure system 44 operatively coupled to the first strings 41, and another reel based closure system operatively coupled to the second strings 42. The reel based closure systems 44 may be coupled to any suitable part of the upper 30, such as the tongue 34 or the cover layer 17 along the lateral side 14 or the medial side. In an alternate embodiment, neither the first strings 41 nor the second strings 42 are operatively coupled to the reel based closure system 44. In such case, the article of footwear 10 may not include the reel based closure system 44.

The eyelets 100 are freely disposed over (but not attached to) the upper 30 in order to allow dynamic adjustment of the first string 41 and the second string 42. In other words, the eyelets 100 are free-floating relative to the upper 30 and are only directly coupled to the first string 41 and the second string 42. Therefore, the eyelets 100 are not necessarily directly attached to the cover layer 17 (or any other of the upper 30). Moreover, the eyelets 100 are closer to the tongue 34 than to the sole structure 20. Furthermore, each eyelet 100 slidably couples the second string 42 to at least one of the first string 41. As such, the first string 41 and the second string 42 can both slide through one eyelet 100, thereby facilitating tightening or loosening the second string 42. Although the drawings show one eyelet 100 slidably coupling the first string 41 to the second string 42, it is contemplated that the eyelet 100 may slidably couple two portions of the same string.

Figure 2:
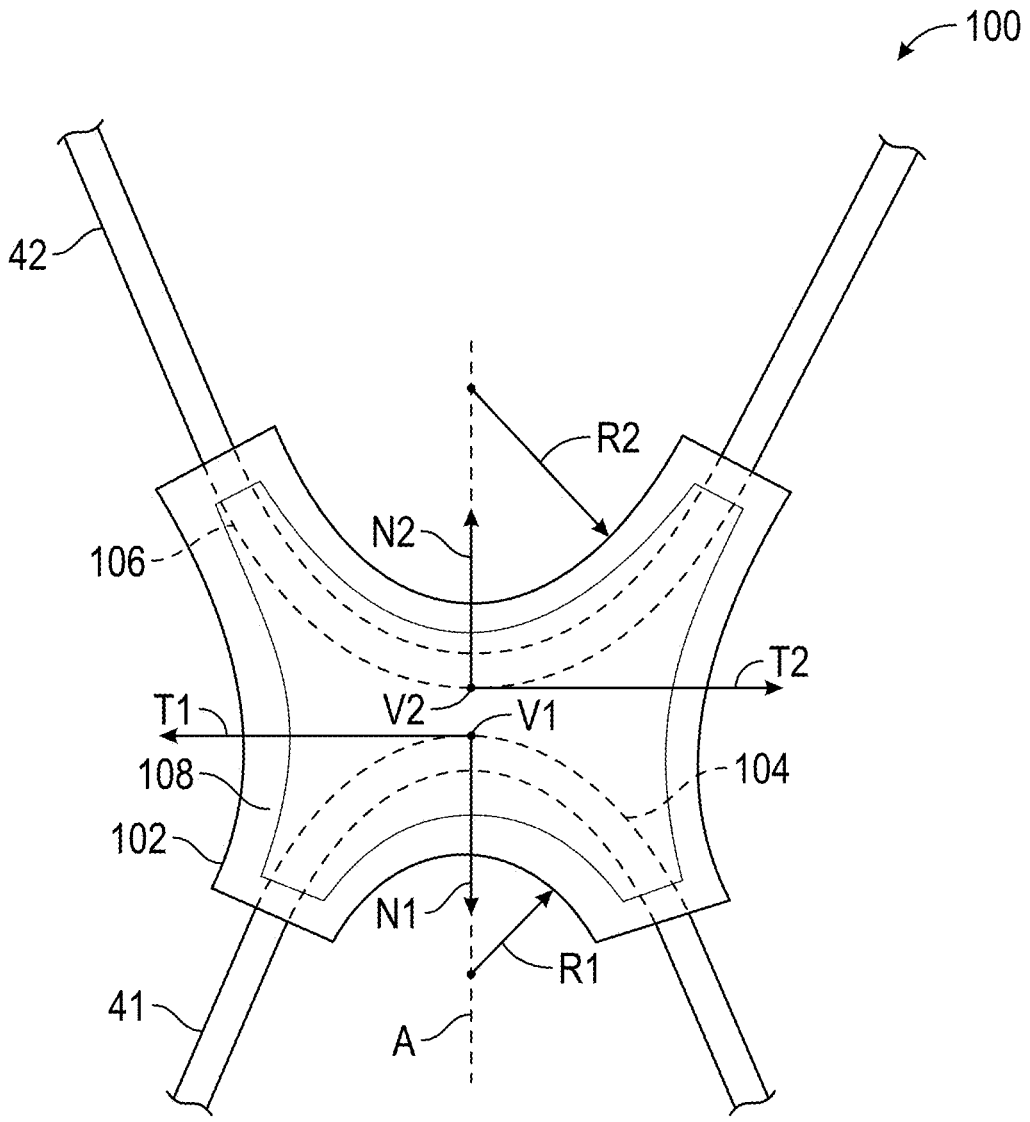
FIG. 2 is a schematic, front view of one of the eyelets shown in FIG. 1.

With reference to FIGS. 1 and 2, each eyelet 100 includes an eyelet body 102 made of a substantially rigid material, such as a rigid polymeric material (e.g. polyamide) or a rigid metallic material, in order to withstand the tensile loads exerted by moving the first string 41 and the second string 42 on the eyelet 100. The eyelet body 102 is configured to slidably couple the first string 41 to the second string 42 and serves as a guide in order to direct the movement of the first string 41 and the second string 42 when the user tightens or loosens the second string 42 to the upper 30. To this end, the eyelet 100 defines a first arc-shaped aperture 104 configured, shaped, and sized to slidably receive the first string 41 and a second arc-shaped aperture 106 configured, shaped, and size to slidably receive the second string 42. A solid, rigid support 108 is disposed between the first arc-shaped aperture 104 and the second arc-shaped aperture 106 in order to prevent direct contact between the portions of the first string 41 and the second string 42 disposed inside the eyelet 100. Each of the first arc-shaped aperture 104 and a second arc-shaped aperture 106 extends through the eyelet body 102 and may be mirror images of each other.

The first arc-shaped aperture 104 has a first vertex V1, and the second arc-shaped aperture 106 has a second vertex V2. In the present disclosure, the term "vertex" means a point where the first derivative of a curvature is zero. In the depicted embodiment, the first vertex V1 is the maximum of the curvature defined by the first arc-shaped aperture 104, and the second vertex V2 is the minimum of the curvature defined by the second arc-shaped aperture 106. The first vertex V1 and the second vertex V2 may be aligned along a linear axis A in order to balance the tensile loads applied to the eyelet 100 by the first string 41 and the second string 42. Accordingly, the linear axis A intersects the first vertex V1 and the second vertex V2. The first arc-shaped aperture 104 has a first tangent vector T1 and a first normal unit vector N1 at the first vertex V1, and the second arc-shaped aperture 106 has a second tangent vector T2 and a second normal unit vector N2 at the second vertex V2. In the present disclosure, the term "tangent vector" means a vector that is tangent to a curve at a given point. The first tangent vector T1 is tangent to the first-arc shaped aperture 104 at the first vertex V1, and the second tangent vector T2 is tangent to the second arc-shaped aperture 106 at the second vertex V2. The term "normal unit vector" means a vector that is perpendicular to a tangent vector. The first normal unit vector N1 is perpendicular to the first tangent vector T1, and the second normal unit vector N1 is perpendicular to the second tangent vector T. The "normal unit vector" and the "tangent vector" are described by the Frenet-Serret formulas. In the present disclosure, the first arc-shaped aperture 104 and the second arc-shaped aperture 106 are mirror images of each other and, as such, the first normal unit vector N1 is opposite to (or otherwise different from) the second normal unit vector N2 in order to allow the first string 41 and the second string 42 to be adjustable independently of each other. In other words, the first arc-shaped aperture 104 and the second arc-shaped aperture 106 are in an opposed relationship to each other.

The first arc-shaped aperture 104 has a radius of curvature R1, and the second arc-shaped aperture has a second radius of curvature R2. The second radius of curvature R1 may be larger than the second radius of curvature R2, or vice-versa, in order to facilitate adjustment of the second string 42 by the reel based closure system 44. It is nevertheless contemplated that the first radius of curvature R1 may be equal to the second radius of curvature R2. Furthermore, the second radius of curvature R2 of the eyelet 100 closest to the reel based closure system 44 is larger than the second radius of curvature R2 of the eyelet 100 that is farthest from the reel based closure system 44. Moreover, the second radius of curvature R2 of the eyelets 100 may incrementally decrease as the eyelets 100 are positioned farther from the reel based closure system 44. Another reel based closure system 44 can also be operatively coupled to the first strings 41. Alternatively, the article of footwear 10 may not include the reel based closure system 44.

Because of the curvature of the first arc-shaped aperture 104 and the second arc-shaped aperture 106, the first strings 41 and the second strings 42 define opposing inflection points (i.e., vertices) inside the eyelets 100 to allow adjustment (e.g., tightening or loosening) of the first string 41 and/or the second strings 42 while minimizing friction. During the adjustment of the first strings 41 and/or the second strings 42, the eyelets 100 are free to move relative to the upper 30 in order to provide the user with more freedom to tighten or loosen the article of footwear 10 in comparison with conventional articles of footwear. The slidable motion of the second string 42 relative to the eyelet 100 is operative to adjust a position of the upper 30 relative to the sole structure.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. For example, although the disclosed article of footwear is configured as a golf shoe, the described concepts associated with the article of footwear, including the upper, may also be applied to a variety of other athletic footwear types, including baseball shoes, basketball shoes, cross-training shoes, cycling shoes, football shoes, tennis shoes, soccer shoes, and hiking boots, among others. The concepts may also be applied to footwear types that are generally considered to be non-athletic, including dress shoes, loafers, sandals, and work boots. The concepts disclosed herein apply, therefore, to a wide variety of footwear types. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

What is claimed is:

1. An article of footwear comprising:

an upper;

a sole structure coupled to the upper;

a plurality of string pairs, each string pair including a first string and a second string;

a plurality of eyelets, each eyelet slidably coupling the first string to the second string of one of the plurality of string pairs, wherein each eyelet comprises:

an eyelet body defining a first arc-shaped aperture and a second arc-shaped aperture, the first arc-shaped aperture having a first radius of curvature, the second arc-shaped aperture having a second radius of curvature, and wherein the second radius of curvature is greater than the first radius of curvature, and wherein each of the first arc-shaped aperture and the second arc-shaped aperture has a respective normal unit vector, and wherein the normal unit vector of the first arc-shaped aperture and the normal unit vector of the second arc-shaped aperture are aligned along a common linear axis; and a reel-based closure system operatively coupled to at least one of the first string or the second string of at least one of the plurality of string pairs.

2. The article of footwear of claim 1, wherein, for each eyelet, the normal unit vector of the first aperture has a first vector direction and the normal unit vector of the second aperture has a second vector direction, and the first vector direction is opposite to the second vector direction.

3. The article of footwear of claim 1, wherein the first arc-shaped aperture has a first tangent vector at a first vertex and the second arc-shaped aperture has a second tangent vector at a second vertex, and the first tangent vector is parallel to the second tangent vector.

4. The article of footwear of claim 3, wherein the first tangent vector has a first tangent direction and the second tangent vector has a second tangent direction, and the first tangent direction is opposite to the second tangent direction.

5. The article of footwear of claim 1, wherein at least one of the plurality of eyelets is freely disposed over the upper.

6. The article of footwear of claim 1, wherein at least one of the plurality of eyelets is not directly attached to the upper.

7. The article of footwear of claim 1, wherein the first string of at least one string pair is at least partially embedded within the upper.

8. The article of footwear of claim 1, wherein the first string of at least one string pair is directly coupled to the sole structure.

9. The article of footwear of claim 1, wherein the reel-based closure system is configured to adjust both the first string and the second string of at least one of the plurality of string pairs.

10. The article of footwear of claim 1, wherein the upper defines at least one string opening, and the first string of at least one string pair at least partially extends through the at least one string opening.

11. The article of footwear of claim 10, wherein the second string of the at least one string pair is at least partially disposed over the upper.

12. The article of footwear of claim 1, wherein each of the plurality of eyelets comprises an eyelet body made of a substantially rigid material.

13. The article of footwear of claim 1, wherein the reel-based closure system includes a rotatable knob configured to tighten or loosen at least one of the first string and the second string.

* * * * *